US008282832B2

(12) United States Patent
Cropp

(10) Patent No.: US 8,282,832 B2
(45) Date of Patent: Oct. 9, 2012

(54) OIL DRIER REGENERATOR

(76) Inventor: Martin Cropp, Christchurch (NZ)

( * ) Notice: Subject to any disclaimer, the term of this patent is extended or adjusted under 35 U.S.C. 154(b) by 193 days.

(21) Appl. No.: 12/529,714

(22) PCT Filed: Apr. 15, 2008

(86) PCT No.: PCT/NZ2008/000080

§ 371 (c)(1),
(2), (4) Date: Sep. 3, 2009

(87) PCT Pub. No.: WO2008/127131

PCT Pub. Date: Oct. 23, 2008

(65) Prior Publication Data

US 2010/0089836 A1 Apr. 15, 2010

(30) Foreign Application Priority Data

Apr. 17, 2007 (NZ) ..... 554563

(51) Int. Cl.

| | |
|---|---|
| ***B01D 24/46*** | (2006.01) |
| ***B01D 29/62*** | (2006.01) |
| ***B01D 33/44*** | (2006.01) |
| ***C02F 1/00*** | (2006.01) |
| ***C02F 1/42*** | (2006.01) |

(52) U.S. Cl. ..... 210/662; 210/670; 210/676; 210/677; 210/689; 210/278; 210/106; 210/167.32; 210/739

(58) Field of Classification Search ..... 210/670, 210/275, 277, 278, DIG. 6, 689, 92, 167.32, 210/662, 677, 175, 180, 181, 182, 269, 675, 210/676, 678

See application file for complete search history.

(56) References Cited

U.S. PATENT DOCUMENTS

| | | | | |
|---|---|---|---|---|
| 2,323,524 | A * | 7/1943 | Downs, Jr. | 210/673 |
| 3,907,686 | A | 9/1975 | Fletcher | |
| 5,389,125 | A | 2/1995 | Thayer | |
| 6,609,411 | B1 * | 8/2003 | Taylor et al. | 73/19.11 |

FOREIGN PATENT DOCUMENTS

| | | | |
|---|---|---|---|
| EP | 452042 | A1 * | 10/1991 |
| EP | 1096515 | | 5/2001 |

* cited by examiner

*Primary Examiner* — Christopher Upton
*Assistant Examiner* — Nader Hossaini
(74) *Attorney, Agent, or Firm* — Galbreath Law Offices, P.C.; John A. Galbreath

(57) ABSTRACT

A regeneration circuit for the in situ regeneration of an inline adsorbent filter, said filter being part of a normal circuit that is configured to remove one or more contaminant from a fluid circulated through a machine; the regeneration circuit includes a regeneration unit configured to remove one or more contaminant from a contaminated fluid creating a regenerated fluid, such that in operation the regenerated fluid is pumped from the regeneration unit and through the filter extracting the or each contaminant from the filter creating the contaminated fluid, this contaminated fluid then returns to the regeneration unit for contaminant removal, the pressure and flow rate of the regenerated fluid through the filter are maintained at a level that ensures minimal damage to the filter; said machine is isolated from the inline filter during regeneration.

19 Claims, 2 Drawing Sheets

OIL DRIER REGENERATOR

FIELD OF THE INVENTION

The present invention is a method for regenerating adsorbent filter media in drying units used to dry oils, in this case the term oil is used to describe any liquid that is immiscible with water, such as those used for transformers and inks. Though the term drying is used it is intended to include the removal of gases or other fluid contaminants of oil.

BACKGROUND

The electrical supply industry uses many transformers to change the voltage of the supply for transmission, improving the efficiency of the transmission network. The transformers most commonly use an insulating oil and cellulose to insulate and separate the windings, the cellulose quickly becoming saturated with the insulating oil shortly after the oil is added. Sometimes the transformers are placed under a partial vacuum prior to the oil addition to speed this process up. The oil is therefore intimately in contact with all of the conductors and any reduction in its insulating or dielectric properties can have detrimental, if not catastrophic, effects. The efficiency may drop or the oil may cease to be an effective insulator resulting in a flashover.

One of the common contaminants that affects the properties of the cellulose/oil and oil properties is water. High water content in the oil or cellulose can:

1. Reduce the dielectric properties of the oil and oil/cellulose.
2. Reduce the insulating properties of the oil and oil/cellulose.
3. Accelerate the breakdown of the cellulose.
4. Exceed saturation point of oil when oil is cooled.
5. Increase corrosion of exposed metal.

The cellulose starts off at below 1% water content but over time leaks in the cooling system, cellulose breakdown and breather desiccant failure/overrun leads to concentrations above this. At present the industry aims to keep the water content in the cellulose between 1% to 3%, with it generally accepted that over 95% of the water within the transformer is in the cellulose. The water concentration of the circulating oil is in equilibrium with the cellulose water concentration, thus any reduction in the oil's water concentration, over time, reduces the cellulose water concentration.

For this reason the oil circulating through transformers is passed through filtering units, that filter and dry the oil. These filtering units may contain dry cellulose, desiccants such as silica gel or acrylic beads, molecular sieves, activated alumina or other means to remove the dissolved or free water and some form of particulate filter. These filtering units eventually become saturated with water and need replacement, refurbishment, regeneration or drying.

Regeneration of the filtering unit can involve the direct exposure of the filter media to a vacuum under either ambient or elevated temperatures to directly evaporate the water. This can detrimentally affect the pore size and/or surface properties of the media, reducing the refurbished filter's effectiveness or life.

As an alternative the transformer oil may be directly dried by spraying the contaminated oil into a vacuum chamber, this replaces the drying action of the filtering media and can require the vacuum system be inline continuously. This can be an expensive exercise and adds another component that requires maintenance; in addition a particulate filter is still often needed. In addition the oil can be damaged from continuous exposure to high levels of vacuum For printing the concentration of water in the ink can affect the print quality and longevity of the inks and printing equipment. The high cost of many inks makes controlling this water content important.

OBJECT OF THE INVENTION

It is an object of the present invention to provide a method of regenerating the adsorbent media in an oil drying filtering unit without removing the unit or filter media and overcoming one or more of the limitations of present systems. In addition a further object is to provide the consumer with a useful choice.

DISCLOSURE OF THE INVENTION

The present invention provides a regeneration circuit for the in situ regeneration of an inline adsorbent filter, said filter being part of a normal circuit that is configured to remove one or more contaminant from a fluid circulated through a machine; the regeneration circuit includes a regeneration unit configured to remove one or more contaminant from a contaminated fluid creating a regenerated fluid, such that in operation the regenerated fluid is pumped from the regeneration unit and through the filter extracting the or each contaminant from the filter, this contaminated fluid then returns to the regeneration unit for contaminant removal, the pressure and flow rate of the regenerated fluid through the filter are maintained at a level that ensures minimal damage to the filter.

Preferably the machine is isolated from the inline filter airing regeneration. In a highly preferred form the regeneration circuit and normal circuit share one or more components. Preferably the shared components include a pump and/or heater. Preferably the heater is only on during the regeneration cycle.

Preferably the regeneration unit includes one or more devices selected from the list consisting of a vacuum evaporation unit, a molecular filter, activated alumina, a desiccant, a membrane filtration unit, a physical separation unit, a reverse osmosis system and a centrifuge. In a highly preferred form the filter is selected from the list consisting of a particulate filter, a cellulose filter, a molecular filter, a desiccant filter, acrylic beads and a combination of these.

In a highly preferred form the contaminant is water. It is preferable that the regeneration unit includes a vacuum evaporation unit. Preferably the regeneration circuit includes a pump. Preferably the vacuum unit includes means for maintaining the level of fluid retained in the vacuum unit sufficient to prevent the pump from cavitating.

Preferably the regeneration circuit includes at least one measurement probe located after the filter, the or each measurement probe is configured to determine the concentration of one or more contaminant present in the contaminated fluid exiting the filter. Preferably the or each measurement probe is selected from the list consisting of a conductivity probe, a pH probe, an infra-red probe, a water concentration probe and oxygen probe and a dissolved gas probe. In a highly preferred form the regeneration circuit includes one or more secondary probes configured to determine one or more fluid properties selected from the list consisting of temperature, pressure, flow rate, density and viscosity.

Preferably the or each contaminant is independently selected from the list consisting of water, particles, oxygen, carbon dioxide, sulphur dioxide, inorganic acids, organic acids, oxidants and alkalis.

In a highly preferred form the regeneration unit is mobile and configured to be releasably attached to the normal circuit when regenerating the filter.

In a highly preferred form the machine is a transformer and the fluid is transformer oil.

In a highly preferred form the filter is not directly exposed to vacuum or the atmosphere during regeneration.

The present invention also provides a method for regenerating an inline filter without removing said filter includes the following steps, in order:

a. normal circuit is isolated,
b. regeneration circuit is connected,
c. fluid is pumped through the regeneration circuit creating regenerated fluid,
d. regenerated fluid is pumped through the filter,
e. the fluid leaving the filter is tested, steps (c) and (d) are repeated until the fluid leaving the filter meets the required standard,
f. the regeneration circuit is isolated, and
g. the normal circuit is re-established.

Preferably the regenerated fluid is heated before step (d). Preferably the fluid is oil and is tested for moisture content.

DESCRIPTION OF THE DRAWINGS

By way of example only a preferred embodiment of the invention will now be described in detail with reference to the accompanying drawings in which:

Referring to FIG. 1 a transformer oil circuit (1) is shown, said oil circuit includes a normal circuit (2) and a regeneration circuit (3) connected together by a first valve (5) and second valve (6).

Figure 1:
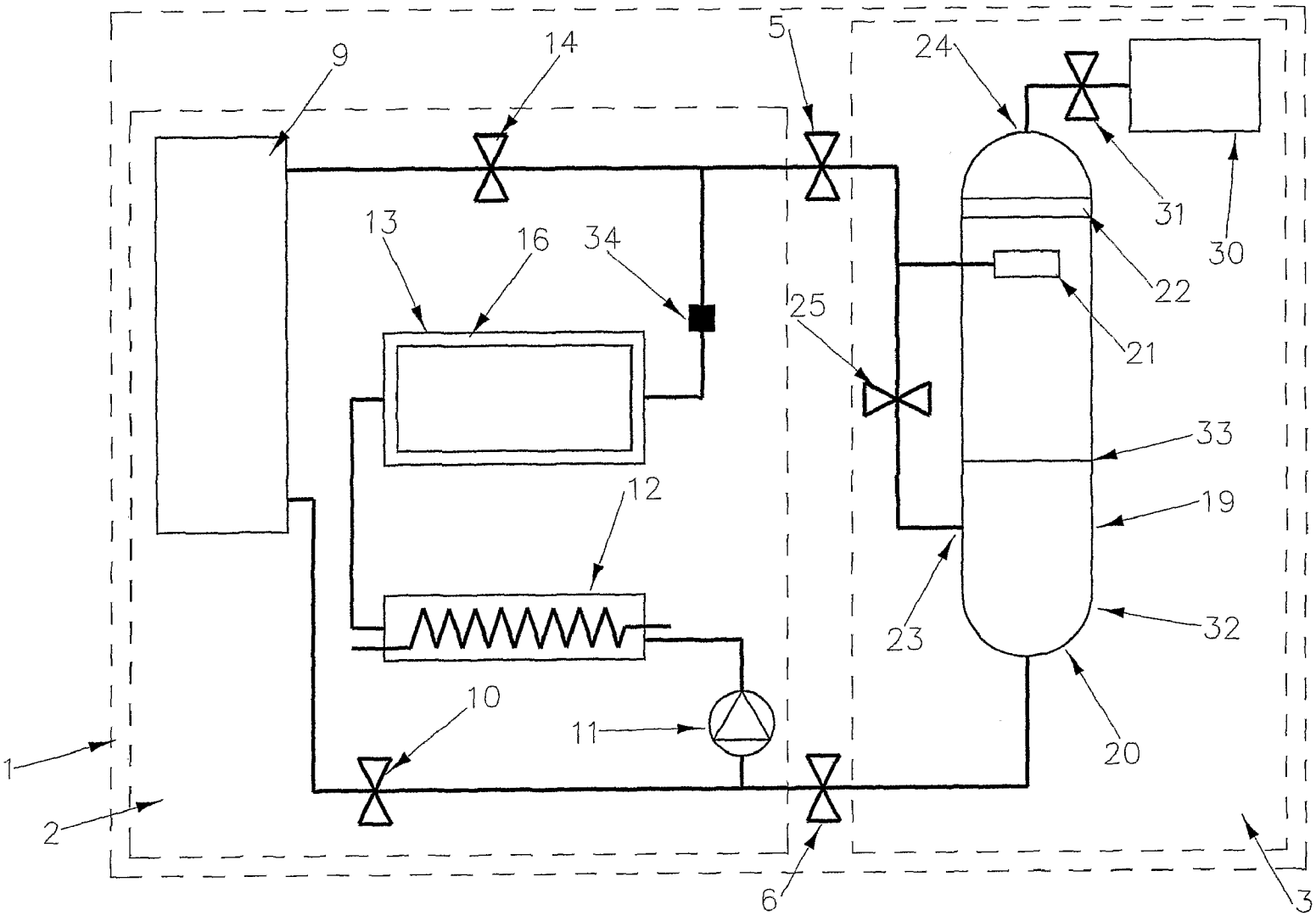
FIG. 1 is a schematic view of the regenerating system connected to a filter unit.

The normal circuit (2) includes the following components:

a transformer (9),
a third valve (10),
a pump (11),
a heater unit (12),
a filter unit (13) and a fourth valve (14). The transformer (9) is connected to the third valve (10), which is in turn independently connected to the pump (11) and the second valve (6). The pump (11) is connected to the heater unit (12), which is in turn connected to the filter unit (13). The filter unit (13) is independently connected to the first valve (5) and the fourth valve (14), said fourth valve (14) is connected to the transformer (9).

The filter unit (13) includes filter media (16) configured, during normal operation, to remove water and other contaminants from the oil passing through it. The filter media (16) inside the filter unit (13) can include particulate filters, desiccants and molecular filters, for example cellulose filters, silica gel and acrylic beads.

The regeneration circuit (3) includes a regeneration unit (19), in this case a vacuum tank (20) of known type; the vacuum tank (20) includes a spray head (21), a mist eliminator (22), a liquid inlet (23) and a vacuum connection (24). The first valve (5) is independently connected to the spray head and a fifth valve (25), the fifth valve (25) is in turn connected to the liquid inlet (23). The vacuum connection (24) is connected to a vacuum source (30) through a sixth valve (31). The spray head (21) is of a standard type configured to form a fine spray of oil within the vacuum tank (20). The mist eliminator (22) is of a standard type configured to remove suspended oil from a gas stream and located immediately before the vacuum connection (24).

During normal operation the first and second valves (5,6) are closed and contaminated oil is drawn from the transformer (9) through the third valve (10), pump (11), heater unit (12) and filter unit (13) respectively then returned to the transformer (9) through the fourth valve (14) as clean and dry oil. The heater unit (12) is not normally used.

Figure 2:
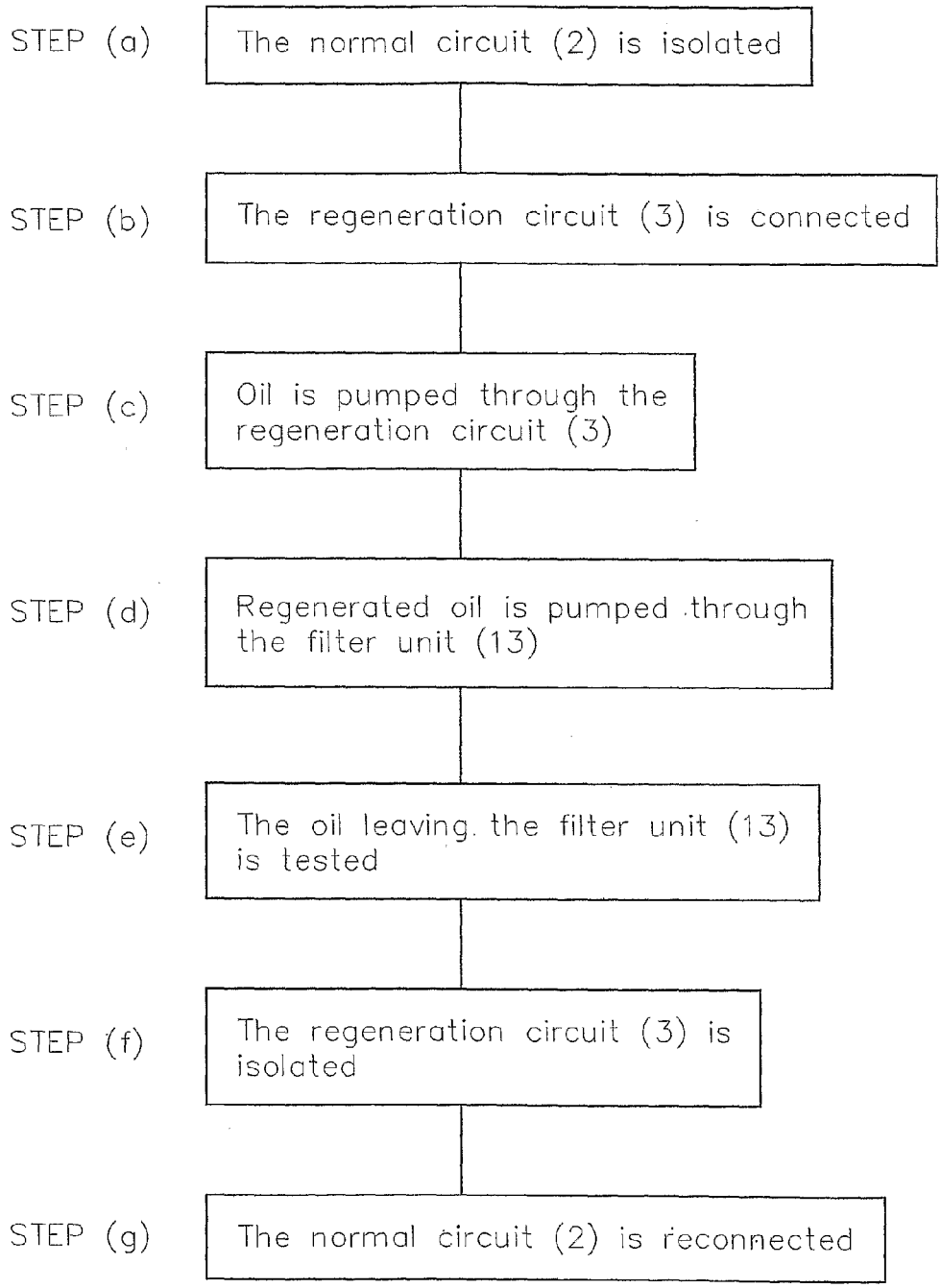
FIG. 2 is a flowchart of the regenerating process.

Referring to FIGS. 1 and 2 the regeneration process includes the following steps, in order:

a. the normal circuit (2) is isolated,
b. the regeneration circuit (3) is connected,
c. oil is pumped through the regeneration circuit (3),
d. the regenerated oil is pumped through the filter unit (13),
e. the oil leaving the filter unit (13) is tested,
f. the regeneration circuit (3) is isolated,
g. the normal circuit (2) is re-established.

In step (a) the third and fourth valves (10,14) are closed which isolates the filter unit (13) from the transformer (9).

In step (b) the first and second valves (5,6) are opened connecting the regeneration circuit (3) to the filter unit (13).

In step (c) the heater unit (12) is turned on to heat the oil, as the temperature of the oil increases it can carry more water, prior to flowing through the filter unit (13). The oil from the filter unit (13) is then pumped to the spray head (21) and the liquid inlet (23). The oil passing through the spray head (21) is atomised and the water separated from the oil by evaporation. The water vapour is drawn off through the mist eliminator (22) to the vacuum source (30) for separation and disposal, any entrained oil is captured by the mist eliminator (22). The now dried liquid oil is collected at the base (32) of the vacuum tank (20) and pumped back to the heater unit (12). The fifth valve (25) is used to adjust the ratio of oil fed to the spray head (21) and liquid inlet (23) to maintain the level of liquid oil (33) inside the vacuum tank (20) sufficient to prevent cavitation of the pump (11).

In step (d) the heated dried oil from the heater unit (12) is pumped through the filter unit (13) where it extracts water from the filter media (16) drying the filter media (16).

In step (e) the water concentration of the oil leaving the filter unit (13) is determined by inline relative saturation probe (34) or by sampling and testing. If the relative saturation of the oil is above 4% then step (c) and (d) are repeated, if not then step (f) is undertaken. Though 4% is indicated this is by way of example only and will vary depending on the required regeneration standard.

In step (f) the heater is turned off and the first and second valves (5,6) are closed then step (g) is undertaken and the third and fourth valves (10,14) are opened returning the filter unit (13) to normal operation.

Throughout the process the pump (11) maintains the correct pressure and flow rate of oil to the filter unit (13) to preserve the physical/operational quality of the filter media (16). This is especially important with the heater unit (12) operating as the physical properties of the oil change, such as viscosity, change with temperature and the surface of the filter media (16) needs to be protected to ensure the effective life of the filter media (16) is not reduced.

It should be noted that the transformer oil volume is many times (100 to 10,000) that of the filter unit (13) and regeneration circuit (3) thus isolating the filter unit (13) for the time required to carry out an in situ regeneration has a minimal effect on the operation of the transformer (9).

In a further embodiment the filter media (16) absorbs gases such as oxygen and carbon dioxide as well as, or instead of, adsorbing or absorbing water.

In a still further embodiment there is more than one filter unit (13) and the regeneration circuit (3) can be used to regenerate one or more filter units (13) while at least one remaining filter unit (13) continues to process the oil.

In a still further, embodiment the filter unit (13) is used to clean ink.

In a still further embodiment the regeneration unit (19) is replaced by an alternative oil/ink drying unit, such as a molecular sieve, membrane filtration unit, centrifuge, desiccant chamber, cryogenic unit or combination of these.

In a further embodiment the regeneration circuit (3) is a mobile unit configured to releasably connect to the normal circuit (2).

In a further embodiment the oil flows in a reverse direction through the filter media (16) during regeneration.

Any discussion of the prior art throughout the specification is not an admission that such prior art is widely known or forms part of the common general knowledge in the field.

The invention claimed is:

1. A regeneration circuit for the in situ regeneration of an inline adsorbent filter, said filter being part of a normal circuit that is adapted to remove one or more contaminant from a liquid circulated through a machine, the regeneration circuit comprising:

a regeneration unit adapted to remove one or more contaminant from a contaminated liquid creating a regenerated liquid;

a pump adapted to move the regenerated liquid from the regeneration unit and through the filter extracting the or each contaminant from the filter creating the contaminated liquid, wherein the contaminated liquid then returns to the regeneration unit for contaminant removal;

valves at the input and output ends of the machine, the valves isolating the machine from the filter being regenerated during regeneration; and wherein the pressure and flow rate of the regenerated liquid through the filter are maintained at a level that ensures minimal damage to the filter.

2. The regeneration circuit as claimed in claim 1 characterised in that said regeneration circuit and normal circuit share one or more components.

3. The regeneration circuit as claimed in claim 2 characterised in that said shared components include the pump and/or a heater.

4. The regeneration circuit as claimed in claim 3 characterised in that the heater is only on during the regeneration cycle.

5. The regeneration circuit as claimed in claim 1 characterised in that the regeneration unit includes one or more devices selected from the list consisting of a vacuum evaporation unit, a molecular filter, activated alumina, a desiccant, a membrane filtration unit, a physical separation unit, a reverse osmosis system and a centrifuge.

6. The regeneration circuit as claimed in claim 1 characterised in that the filter is selected from the list consisting of a particulate filter, a cellulose filter, a molecular filter, a desiccant filter, acrylic beads and a combination of these.

7. The regeneration circuit as claimed in claim 1 characterised in that the or each contaminant is independently selected from the list consisting of water, particles, oxygen, carbon dioxide, sulphur dioxide, inorganic acids, organic acids, oxidants and alkalis.

8. The regeneration circuit as claimed in claim 3 characterised in that the regeneration unit includes a vacuum evaporation unit.

9. The regeneration circuit as claimed in claim 1 characterised in that the regeneration circuit includes at least one measurement probe located after the filter, the or each measurement probe is configured to determine the concentration of one or more contaminant present in the contaminated liquid exiting the filter.

10. The regeneration circuit as claimed in claim 9 characterised in that the or each measurement probe is selected from the list consisting of a conductivity probe, a pH probe, an infra-red probe, a water concentration probe an oxygen probe and a dissolved gas probe.

11. The regeneration circuit as claimed in claim 1 characterised in that the regeneration circuit includes one or more secondary probes configured to determine one or more liquid properties selected from the list consisting of temperature, pressure, flow rate, density and viscosity.

12. The regeneration circuit as claimed in claim 1 characterised in that the regeneration unit is mobile and configured to be releasably attached to the normal circuit when regenerating the filter.

13. The regeneration circuit as claimed in claim 1 characterised in that the liquid is an oil.

14. The regeneration circuit as claimed in claim 1 characterised in that the machine is a transformer and the liquid is transformer oil.

15. The regeneration circuit as claimed in claim 1 characterised in that the filter is not directly exposed to vacuum or the atmosphere during regeneration.

16. A method for regenerating an inline filter without removing said filter includes the following steps, in order:

a. a normal circuit is isolated, b. a regeneration circuit is connected, c. a liquid is pumped through the regeneration circuit, d. a regenerated liquid is pumped through the filter, e. the contaminated liquid leaving the filter is tested, steps (c) and (d) are repeated until the contaminated liquid leaving the filter meets the required standard, f. the regeneration circuit is isolated, and g. the normal circuit is re-established.

17. The method as claimed in claim 16 characterised in that the regenerated liquid is heated before step (d).

18. The method as claimed in claim 16 characterised in that the liquid is oil.

19. The method as claimed in claim 16 characterised in that the contaminated liquid is tested for moisture content.

* * * * *